US010867551B2

(12) United States Patent
Ok et al.

(10) Patent No.: US 10,867,551 B2
(45) Date of Patent: Dec. 15, 2020

(54) DEGRADATION COMPENSATION DEVICE AND ORGANIC LIGHT EMITTING DISPLAY DEVICE INCLUDING THE SAME

(71) Applicant: SAMSUNG ELECTRONICS CO., LTD., Suwon-si (KR)

(72) Inventors: Ji Heon Ok, Wonju-si (KR); Yong Hoon Yu, Suwon-si (KR); Joo Hyuk Yum, Yongin-si (KR); Jae Youl Lee, Hwaseong-si (KR); Byoung Yoon Jang, Gimhae-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/285,755

(22) Filed: Feb. 26, 2019

(65) Prior Publication Data

US 2020/0058249 A1 Feb. 20, 2020

(30) Foreign Application Priority Data

Aug. 14, 2018 (KR) ..... 10-2018-0094677

(51) Int. Cl.
*G09G 3/3208* (2016.01)

(52) U.S. Cl.
CPC ... *G09G 3/3208* (2013.01); *G09G 2320/0233* (2013.01); *G09G 2320/0276* (2013.01); *G09G 2320/046* (2013.01); *G09G 2320/048* (2013.01); *G09G 2320/0626* (2013.01); *G09G 2320/0673* (2013.01); *G09G 2360/16* (2013.01)

(58) Field of Classification Search
CPC ... G09G 2320/0233; G09G 2320/0276; G09G 2320/046; G09G 2320/048; G09G 2320/0626; G09G 2320/0673; G09G 2360/16; G09G 3/3208; G09G 2320/043; G09G 2320/045
See application file for complete search history.

(56) References Cited

U.S. PATENT DOCUMENTS 6,372,608 B1 4/2002 Shimoda et al.
6,645,830 B2 11/2003 Shimoda et al.
(Continued)

FOREIGN PATENT DOCUMENTS

KR 10-2016-0059057 5/2016
KR 10-2016-0083591 7/2016
(Continued)

*Primary Examiner* — Michael J Jansen, II
*Assistant Examiner* — Sosina Abebe
(74) *Attorney, Agent, or Firm* — F. Chau & Associates, LLC

(57) ABSTRACT

A degradation compensation device and an organic light emitting display device including the same are provided. The degradation compensation device includes a degradation rate acquisition unit acquiring estimated degradation rates, estimated with respect to a plurality of respective pixels, based on panel usage information, a digital compensation unit performing digital compensation to lower a digital gradation of each pixel, based on a luminance of a pixel having a maximum degradation rate, among the estimated degradation rates, and an analog compensation unit performing analog compensation to increase luminance of the plurality of pixels by changing an analog voltage supplied to a panel, after performing the digital compensation.

20 Claims, 10 Drawing Sheets

(56) References Cited

U.S. PATENT DOCUMENTS

| | | | |
|---|---|---|---|
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,067,932 | B1 | 8/2006 | Okuyama et al. |
| 7,084,420 | B2 | 8/2006 | Kim et al. |
| 7,154,124 | B2 | 12/2006 | Han et al. |
| 7,199,771 | B2 | 4/2007 | Yamazaki et al. |
| 7,208,725 | B2 | 4/2007 | Sherrer et al. |
| 7,288,758 | B2 | 10/2007 | Sherrer et al. |
| 7,319,044 | B2 | 1/2008 | Han et al. |
| 7,501,656 | B2 | 3/2009 | Han et al. |
| 7,709,857 | B2 | 5/2010 | Kim et al. |
| 7,759,140 | B2 | 7/2010 | Lee et al. |
| 7,781,727 | B2 | 8/2010 | Sherrer et al. |
| 7,790,482 | B2 | 9/2010 | Han et al. |
| 7,940,350 | B2 | 5/2011 | Jeong |
| 7,959,312 | B2 | 6/2011 | Yoo et al. |
| 7,964,881 | B2 | 6/2011 | Choi et al. |
| 7,985,976 | B2 | 7/2011 | Choi et al. |
| 7,994,525 | B2 | 8/2011 | Lee et al. |
| 8,013,352 | B2 | 9/2011 | Lee et al. |
| 8,049,161 | B2 | 11/2011 | Sherrer et al. |
| 8,088,683 | B2 | 1/2012 | Ramkumar et al. |
| 8,129,711 | B2 | 3/2012 | Kang et al. |
| 8,179,938 | B2 | 5/2012 | Kim |
| 8,263,337 | B2 | 9/2012 | Choi et al. |
| 8,324,646 | B2 | 12/2012 | Lee et al. |
| 8,399,944 | B2 | 3/2013 | Kwak et al. |
| 8,432,511 | B2 | 4/2013 | Jeong |
| 8,459,832 | B2 | 6/2013 | Kim |
| 8,502,242 | B2 | 8/2013 | Kim |
| 8,536,604 | B2 | 9/2013 | Kwak et al. |
| 8,711,136 | B2 | 4/2014 | Park |
| 8,735,931 | B2 | 5/2014 | Han et al. |
| 8,766,295 | B2 | 7/2014 | Kim |
| 9,183,785 | B2 | 11/2015 | Kim |
| 9,697,776 | B2 | 7/2017 | Jun et al. |
| 9,767,734 | B2 | 9/2017 | Jun et al. |
| 9,786,221 | B2 | 10/2017 | Bae et al. |
| 9,858,857 | B2 | 1/2018 | Kim et al. |
| 9,898,961 | B2 | 2/2018 | Jeong et al. |
| 9,905,162 | B2 | 2/2018 | Yoo |
| 9,940,872 | B2 | 4/2018 | An et al. |
| 2013/0147693 | A1* | 6/2013 | Bae ..... G09G 3/3208 345/82 |
| 2014/0168192 | A1* | 6/2014 | Jeong ..... G09G 3/3258 345/212 |
| 2016/0103171 | A1* | 4/2016 | Tsutsui ..... G09G 3/006 257/40 |
| 2016/0372032 | A1 | 12/2016 | Yang et al. |
| 2017/0076659 | A1* | 3/2017 | Zhang ..... G09G 3/3208 |
| 2017/0162103 | A1 | 6/2017 | An et al. |
| 2018/0075802 | A1* | 3/2018 | Liu ..... G09G 3/20 |
| 2019/0189050 | A1* | 6/2019 | Choi ..... G09G 3/3291 |

FOREIGN PATENT DOCUMENTS

| | | |
|---|---|---|
| KR | 10-2016-0089923 | 7/2016 |
| KR | 10-2016-0089945 | 7/2016 |
| KR | 10-2016-0148828 | 12/2016 |
| KR | 10-2017-0000038 | 1/2017 |
| KR | 10-20170003251 | 1/2017 |
| KR | 10-2017-0067189 | 6/2017 |
| KR | 10-2017-0067200 | 6/2017 |
| KR | 10-2017-0081790 | 7/2017 |
| KR | 10-2018-0030342 | 3/2018 |

* cited by examiner

| | | B | G | R |
|---|---|---|---|---|
| | Module optimal beta | 0.78 | 1 | 0.72 |
| | | Tau (year) | | |
| Voltage (based on green) | Luminance (nit, based on green) | B | G | R |
| 6.500 | 0 | 7.304E+12 | 2.43E+09 | 3.4737E+10 |
| 5.011 | 4.25 | 39400.023 | 2835.967 | 109618.508 |
| 4.587 | 24.78 | 1249.332 | 151.183 | 7230.010 |
| 4.314 | 62.10 | 185.766 | 28.576 | 1496.073 |
| 4.098 | 116.62 | 48.613 | 8.716 | 477.439 |
| 3.883 | 201.66 | 14.217 | 2.965 | 163.630 |
| 3.694 | 307.68 | 1.320 | 1.259 | 67.931 |
| 3.514 | 442.40 | 2.259 | 0.601 | 30.934 |
| 3.334 | 605.91 | 10.035 | 14.804 | 14.804 |
| 3.154 | 819.06 | 0.513 | 0.143 | 7.445 |
| 2.977 | 1038.11 | 0.277 | 0.105 | 3.904 |
| 2.802 | 1804.18 | 0.162 | 0.069 | 2.149 |
| 2.627 | 1542.08 | 0.102 | 0.048 | 1.245 |
| 2.405 | 1848.00 | 0.063 | 0.034 | 3.680 |
| 2.135 | 2055.63 | 0.042 | 0.027 | 3.367 |
| 1.865 | 2203.15 | 0.032 | 0.024 | 0.221 |
| 1.663 | 2263.02 | 0.029 | 0.026 | 0.163 |

FIG. 6

DEGRADATION COMPENSATION DEVICE AND ORGANIC LIGHT EMITTING DISPLAY DEVICE INCLUDING THE SAME

CROSS-REFERENCE TO RELATED APPLICATION(S)

This application claims benefit of priority to Korean Patent Application No. 10-2018-0094677 filed on Aug. 14, 2018 in the Korean Intellectual Property Office, the disclosure of which is incorporated herein by reference in its entirety.

BACKGROUND

1. Field

The present inventive concept relates to a degradation compensation device and an organic light emitting display device including the same. More particularly, the present inventive concept relates to a degradation compensation device, and for performing digital compensation and analog compensation.

2. Description of Related Art

In organic light emitting diodes (OLEDs), the degree of luminance may be lowered depending on a driving period and the amount of driving current, a main cause of deteriorating quality in OLED displays.

The deterioration of a device may appear as a decrease in luminescence or brightness, and uneven deterioration occurs between a channel and a device depending on usage time. As a result, the quality of an image deteriorates due to the degradation in luminance, color shift and degradation in uniformity.

SUMMARY

An aspect of the present inventive concept is to provide a degradation compensation device, capable of preventing afterimage and maintaining image quality, by maintaining starting luminance and chromaticity in a state before deterioration of an OLED device occurs, for as long as possible, and an organic light emitting display device including the same.

According to an aspect of the present inventive concept, a degradation compensation device includes a degradation rate acquisition unit acquiring estimated degradation rates, estimated with respect to a plurality of respective pixels, based on panel usage information; a digital compensation unit performing digital compensation to lower a digital gradation of each pixel, based on a luminance of a pixel having a maximum degradation rate, among the estimated degradation rates; and an analog compensation unit performing analog compensation to increase luminance of the plurality of pixels by changing an analog voltage supplied to a panel, after performing the digital compensation.

According to an aspect of the present inventive concept, an organic light emitting display device includes a panel; and a degradation compensation device. The degradation compensation device includes a degradation rate acquisition unit acquiring estimated degradation rates, estimated with respect to a plurality of respective pixels, using a stretched exponential decay model generated using cumulative degradation amount information obtained by accumulating a degradation amount, based on usage information with respect to the panel; a digital compensation unit performing digital compensation, using the degradation rates with respect to the plurality of respective pixels; and an analog compensation unit performing analog compensation by changing an analog voltage supplied to the panel, after performing the digital compensation.

According to an aspect of the present inventive concept, an organic light emitting display device includes a panel; and a degradation compensation device estimating degradation rates with respect to a plurality of respective pixels by passing cumulative degradation amount information through a stretched exponential decay model defined by a degradation rate function over time, using voltage information for actual pixel output based on the panel, the degradation compensation device calculating a compensation voltage for each pixel, based on a luminance of a pixel having a maximum degradation rate among the degradation rates estimated by the degradation compensation device, to supply the compensation voltage to the plurality of pixels, and calculating a gamma tap voltage supplied to the panel to change an analog voltage of a source driver.

BRIEF DESCRIPTION OF DRAWINGS

The above and other aspects, features, and advantages of the present disclosure will be more clearly understood from the following detailed description, taken in conjunction with the accompanying drawings, in which:

FIG. 6 illustrates a table summarizing measurement data with respect to a relationship between a voltage and time according to exemplary embodiments of the present inventive concept;

DETAILED DESCRIPTION

Figure 1:
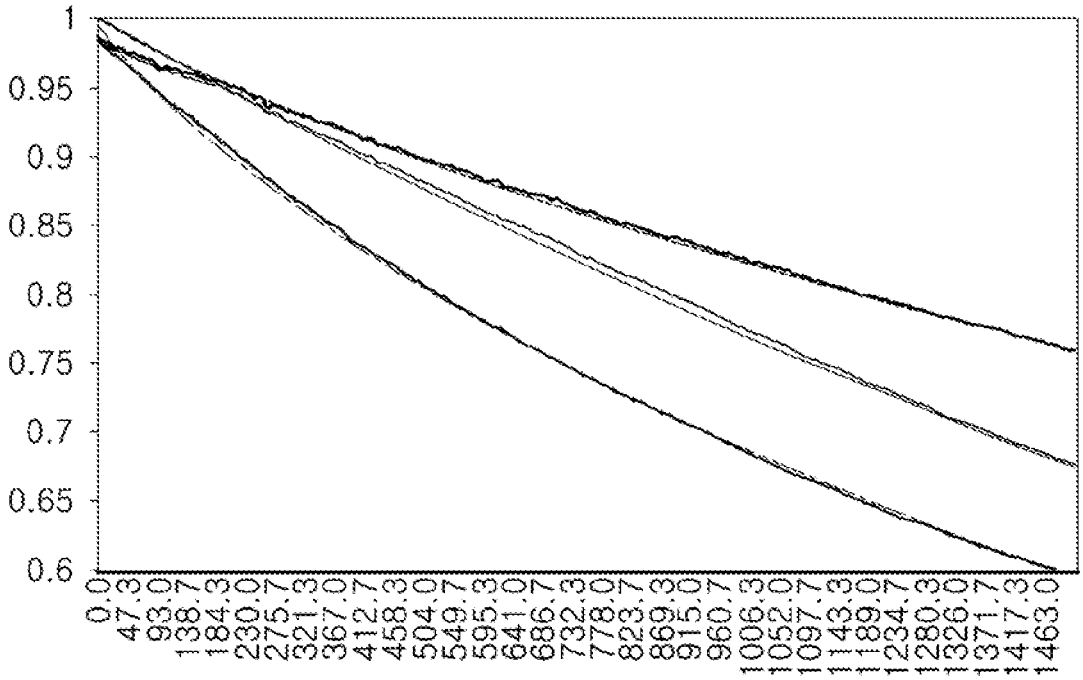
FIG. 1 is a graph illustrating a decrease in luminance for each channel over driving time of an organic light emitting display device.

Hereinafter, exemplary embodiments of the present inventive concept will be described with reference to the accompanying drawings.

The advantages and features of the present inventive concept and the manner of achieving them will become apparent with reference to the embodiments described in detail below with reference to the accompanying drawings. The present inventive concept may, however, be embodied in many different forms and should not be construed as being limited to the embodiments set forth herein. Rather, these embodiments are provided so that this disclosure will be thorough and complete, and will fully convey the scope of the invention to those skilled in the art. The invention is only defined by the scope of the claims. Like reference numerals refer to like elements throughout the specification.

The terms 'unit', 'module', 'table', etc. used in the present embodiment mean software and hardware component elements such as a field programmable gate array (FPGA) or an Application Specific Integrated Circuit (ASIC), and 'module' performs certain functions. However, modules are not meant to be limited to software or hardware. A module may be configured to reside on an addressable storage medium and configured to play one or more processors. Thus, by way of example, a module may include components such as software components, object-oriented software components, class components and task components, and processes, functions, attributes, procedures, subroutines, Microcode, circuitry, data, databases, data structures, tables, arrays, and variables, as will be appreciated by those skilled in the art. The functions provided in the components and modules may be combined into a smaller number of components and modules or further separated into additional components and modules. In addition, components and modules may be implemented to reproduce one or more central processing units (CPUs) in the device.

FIG. 1 is a graph illustrating a decrease in luminance for each channel over driving time of an organic light emitting display device. In the case of an organic light emitting diode (OLED) device of an organic light emitting display, non-uniform degradation may occur, depending on an operating period of time, such that afterimages may appear. Alternatively, as illustrated in FIG. 1, a color shift phenomenon may occur due to a difference in the degradation progress speed of R, G and B elements, as illustrated in FIG. 1, resulting in deterioration of quality.

Thus, the deterioration of a device may appear as a decrease in luminescence or brightness, and uneven deterioration occurs between a channel and a device depending on usage time. As a result, the quality of an image deteriorates due to the degradation in luminance, color shift and degradation in uniformity.

Figure 2:
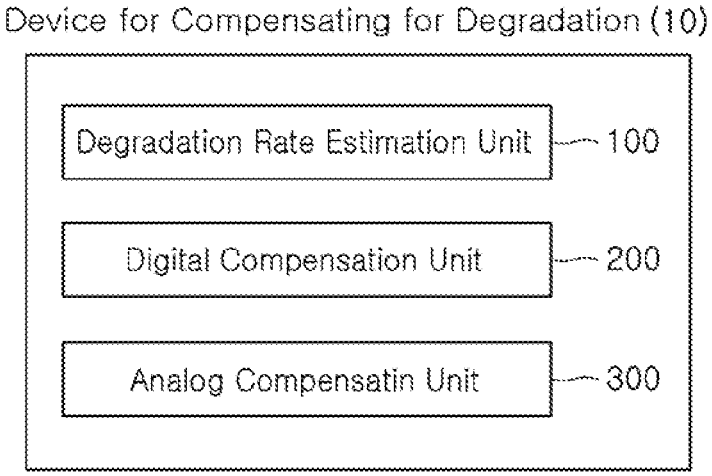
FIG. 2 is a block diagram illustrating a degradation compensation device according to exemplary embodiments of the present inventive concept.

FIG. 2 is a block diagram illustrating a degradation compensation device according to exemplary embodiments of the present inventive concept. As illustrated in FIG. 2, a device 10 for compensating for degradation according to exemplary embodiments may include a degradation rate estimation unit 100, a digital compensation unit 200, and an analog compensation unit 300. A degradation estimation unit 100 may also be referred to as a degradation rate acquisition unit.

The degradation rate estimation unit 100 may obtain estimated degradation rates with respect to a plurality of respective pixels based on panel usage information. The panel usage information may indicate information regarding a voltage used for actual pixel output based on a display driver stage of the panel. The degradation rate estimation unit 100 may correspond the degradation rate estimation unit 100 described with reference to FIG. 3.

The digital compensation unit 200 may perform digital compensation based on the estimated degradation rates obtained by the degradation rate estimation unit 100. The digital compensation unit 200 may correspond to the digital compensation unit 200 described with reference to FIG. 7.

The analog compensation unit 300 may perform analog compensation based on the estimated degradation rates obtained by the degradation rate estimation unit 100. The analog compensation unit 300 may correspond to the analog compensation unit 300 described with reference to FIG. 10.

Thus, the degradation compensation device may determine voltage information for a plurality of pixels of a display panel, estimate a degradation amount for each of the plurality of pixels based on the corresponding voltage information, calculate a compensation voltage for each of the plurality of pixels based at least in part on the corresponding degradation amount, and supply the compensation voltage the corresponding pixel.

Figure 3:
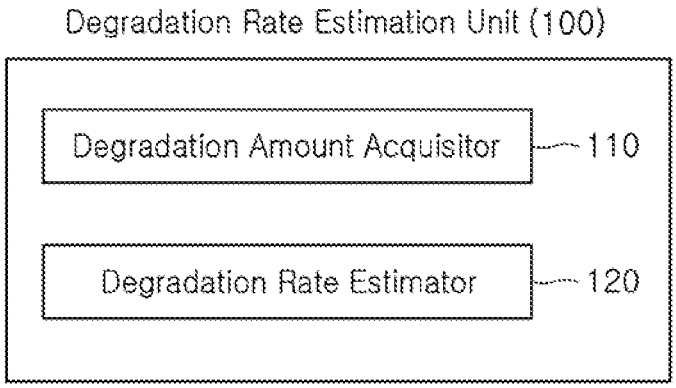
FIG. 3 is a block diagram of a degradation rate estimator according to exemplary embodiments of the present inventive concept.

FIG. 3 is a block diagram illustrating the degradation rate estimation unit 100 according to exemplary embodiments. As illustrated in FIG. 3, the degradation rate estimation unit 100 may include a degradation amount acquisitor 110 and a degradation rate estimator 120.

The degradation amount acquisitor 110 may accumulate a degradation amount, based on a voltage for actual pixel output, where the voltage is based on a panel in the display driver stage.

As described above, the degradation compensation device according to exemplary embodiments may not accumulate the degradation amount based on image data (digital gradation), but rather measures the voltage for actual pixel output according to the characteristics of each panel in the display driver stage. The degradation of the pixel will be affected by the cumulative through-current since the voltage for the actual pixel output on the display driver stage is directly related to the through-current. According to exemplary embodiments, a relatively large amount of accurate cumulative degradation information may be obtained by applying the method considering the characteristics of the panel. For example, the voltage information of each gradation determined in a gamma voltage generator may be used as a voltage for actual pixel output.

The degradation rate estimator 120 may utilize a stretched exponential decay model in which the cumulative degradation amount information is defined by a degradation rate function over time, to estimate degradation rates for a plurality of respective pixels. The degradation rate may indicate a ratio of luminance after a decrease in luminance due to degradation, relative to starting luminance.

Figure 4:
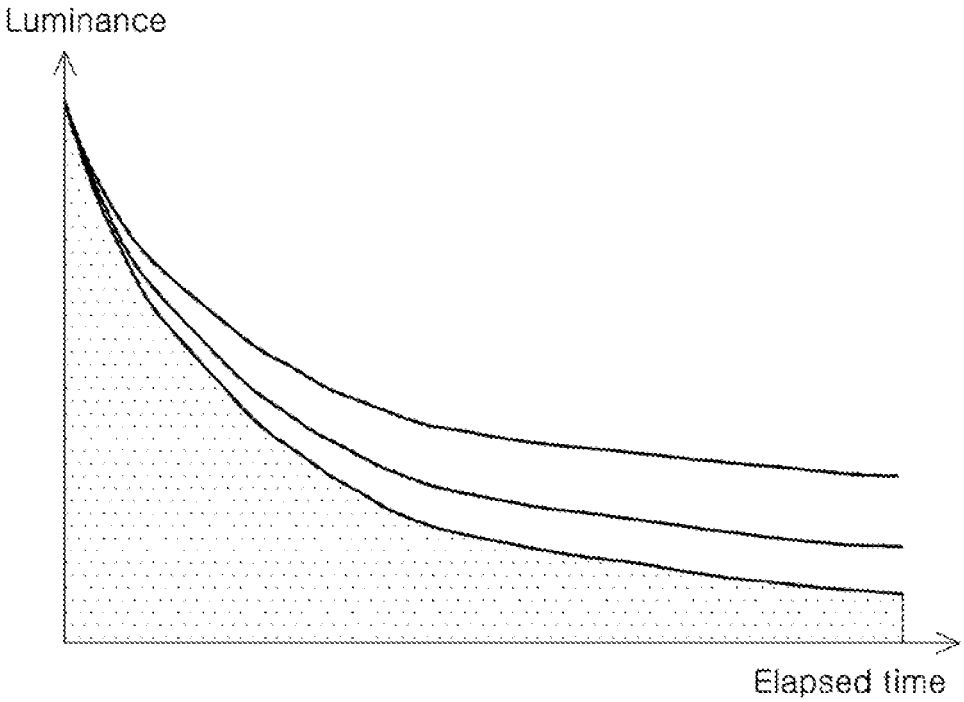
FIG. 4 is a graph illustrating a result of measuring luminance data over time for each channel by capturing an image according to a degradation progression according to exemplary embodiments of the present inventive concept.

FIG. 4 is a graph illustrating a result of measuring luminance data over time for each channel by capturing an image according to a degradation progression according to exemplary embodiments of the present inventive concept.

A degradation test may be performed to measure an output state, for example, a luminance degradation degree depending on a driving voltage, and to extract a stretched exponential decay model. In this case, reliable measurement of the luminance degradation degree should be performed, and the output state, for example, a driving voltage, should be precisely defined. To conduct the degradation test, various driving voltages may be input to a panel for respective channels. In some cases, a degradation pattern for modeling may be used. For example, a pattern including 16 data points per channel (i.e., R/G/B/W channels) may be used.

Various driving voltages for each channel (R/G/B/W) may be input to perform a degradation progression, and then images may be captured using radiant equipment depending on the degradation progression, thereby measuring luminance reduction over time.

The stretched exponential decay model may have, for example, the form of a stretched exponential decay model as illustrated in Equation 1. Thus, the degradation test may be used to extract the parameters of Equation 1.

$$\frac{L}{L_0} = \exp\left[-\left(\frac{t}{\tau}\right)^{\beta}\right] \tag{1}$$

In Equation 1, L represents luminance and $L_0$ indicates a starting luminance. The parameter t is a time variable, and $\tau$ is a decay time constant, time taken for degradation to reach a predetermined reference level, as compared with starting luminance. For example, when a preset reference is set to 63.2%, $\tau$ may indicate a period of time taken for degradation to reach 63.2% (L/L0=0.368) of a starting luminance.

The parameter $\beta$ may be related to degradation type, and indicates a constant value (i.e., a stretch factor describing initial drop sharpness) determined for each channel, irrespective of gradation. After determining the $\beta$ and $\tau$ parameters using data obtained by measuring the luminance, a $\beta$ value having a smallest error is selected for each channel, and an appropriate value of $\tau$ for each piece of data is determined.

Figure 5:
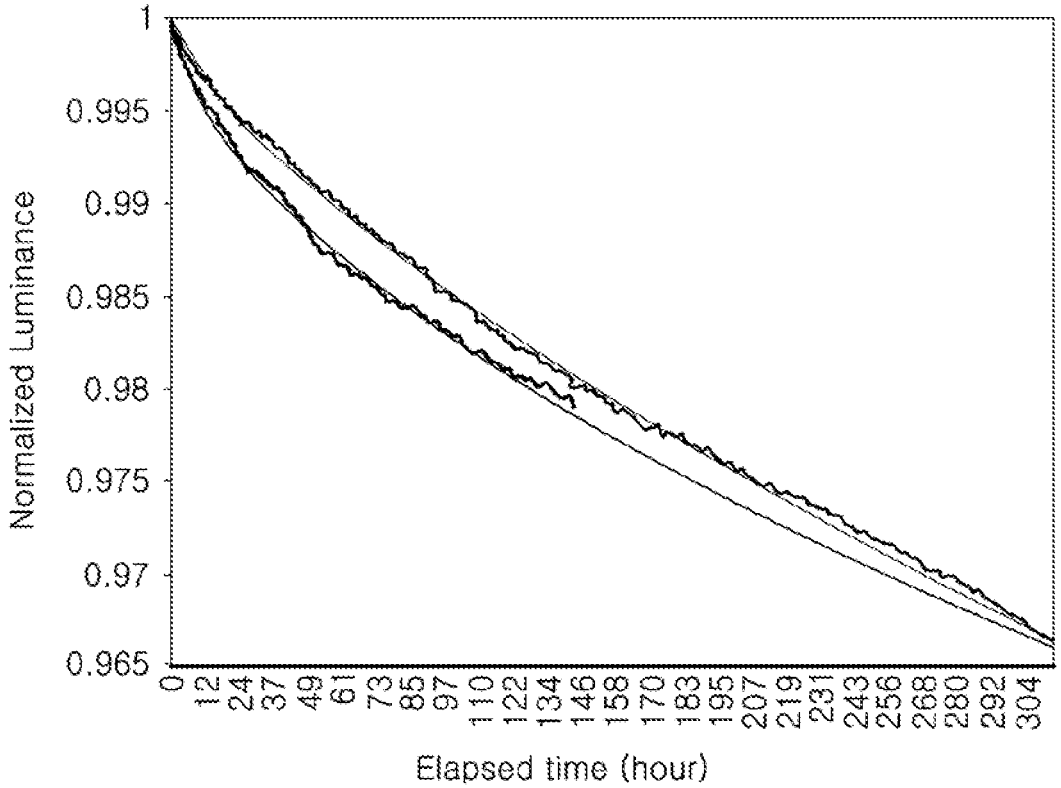
FIG. 5 is a graph illustrating a process of modeling a stretched exponential decay model using the graph of measured results according to exemplary embodiments of the present inventive concept.

FIG. 5 is a graph illustrating a process of modeling a stretched exponential decay model using the graph of measured results according to exemplary embodiments of the present inventive concept.

FIG. 6 is a table summarizing actual measurement data on the relationship between voltage and lifetime ($\tau$) according to exemplary embodiments of the present inventive concept. OLED lifetime degradation may be related to a cumulative current having passed, since a driving voltage is directly related to through-current. Thus, in an exemplary embodiment of the present inventive concept, a relationship between a driving voltage and the lifetime (i.e., the time $\tau$) may be measured, rather than a relationship between a cumulative current having passed and the lifetime. These measurements may then be used to construct a model. That is, as a result of the modeling, a stretched exponential decay model may be generated and used.

Figure 7:
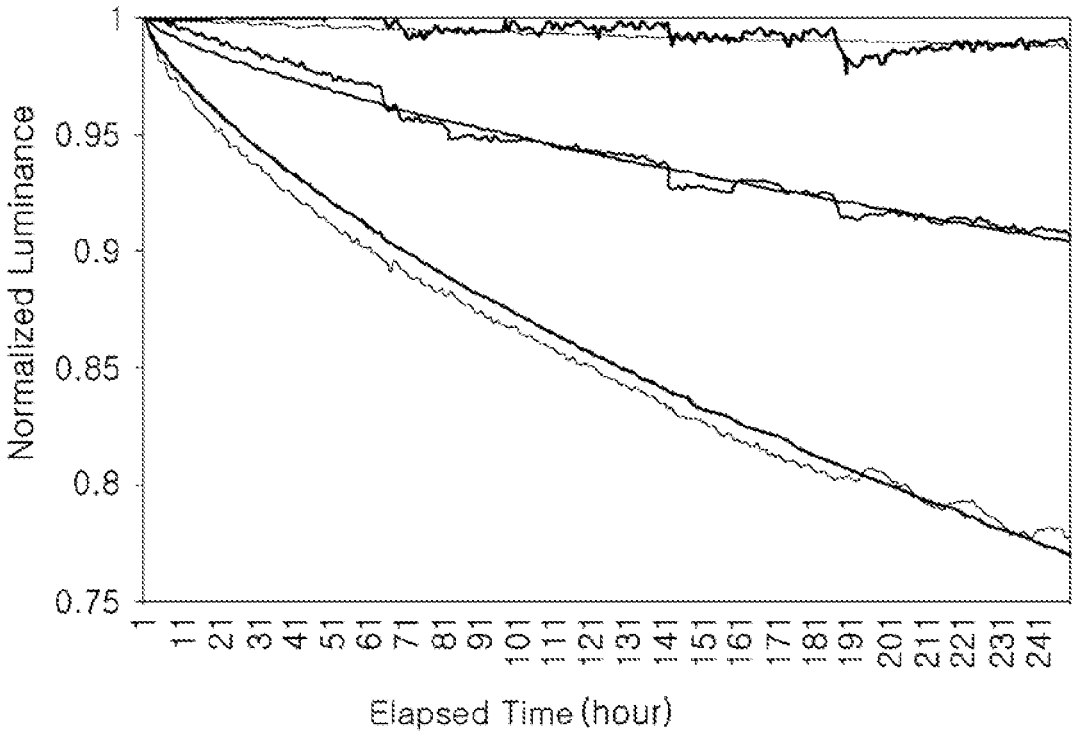
FIG. 7 is a graph illustrating a curve illustrating actual measurement data and a curve for a stretched exponential decay model result extracted based on the actual measurement data according to exemplary embodiments of the present inventive concept.

FIG. 7 is a graph illustrating a curve illustrating actual measurement data and a curve for a resulting stretched exponential decay model extracted based on the actual measurement data according to exemplary embodiments of the present inventive concept.

Based on the above-described voltage-$\tau$ (time) relationship, when a specific voltage is input, a degradation amount may be accumulated by $1/\tau$ (in unites of stress per unit time). As luminance increases, the lifetime ($\tau$) may decrease, and thus, a relatively larger amount of degradation may be accumulated. The parameter $\tau$ may be converted into the unit of a frame, such that a normalized unit is accumulated when a highest luminance voltage is applied in a single frame, and a relative value (<=1) may be accumulated when a lesser voltage is applied. The cumulative degradation amount may be converted into a degradation rate by passing through a stretched exponential decay model (SED) function previously determined through a degradation experiment.

In the present inventive concept, the degradation amount may indicate the reverse of the time taken until the luminance decreases to a predetermined ratio by continuously applying a predetermined voltage with respect to a starting luminance. The degradation rate may indicate a ratio of luminance after the decrease (i.e., due to degradation) to a starting luminance.

Figure 8:
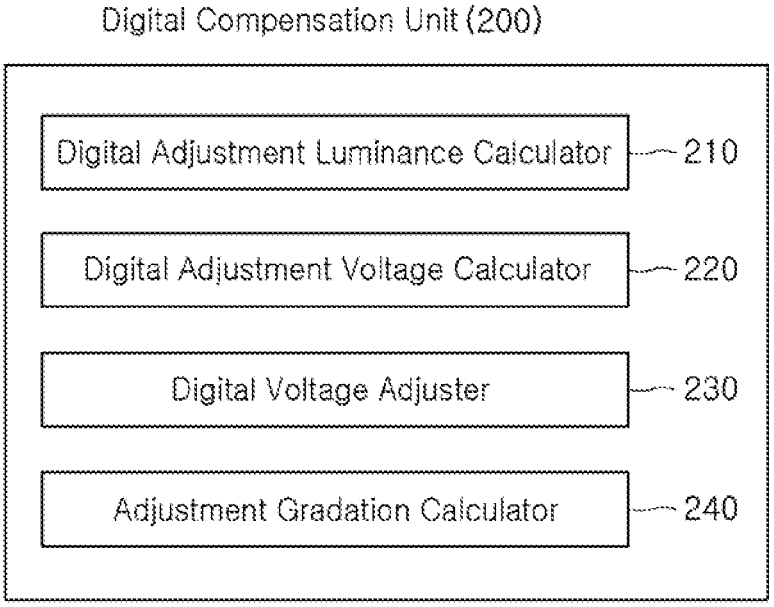
FIG. 8 is a block diagram illustrating the digital compensation unit according to exemplary embodiments of the present inventive concept.
Figure 9:
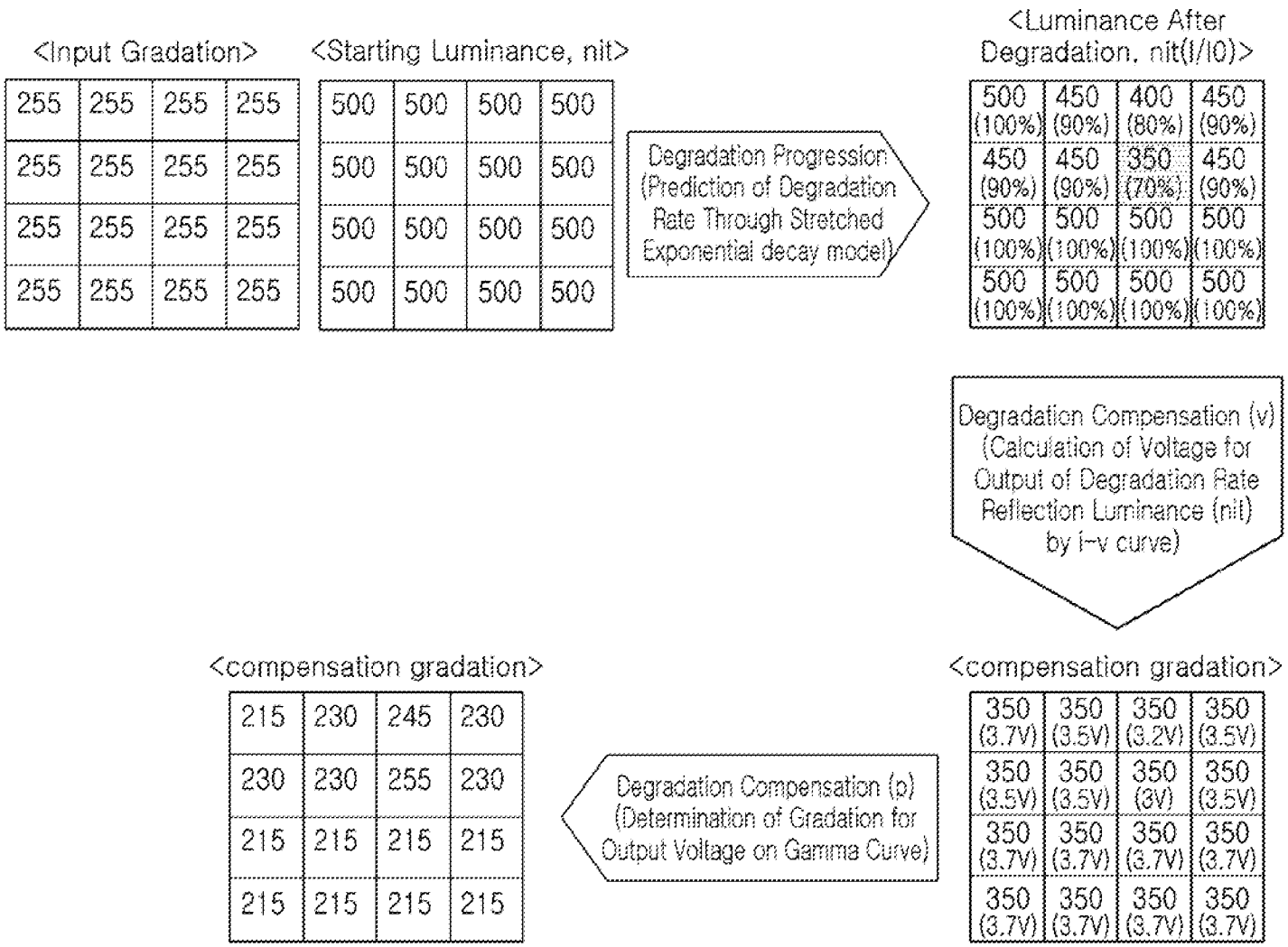
FIG. 9 is a schematic diagram illustrating a digital compensation process according to exemplary embodiments of the present inventive concept.

FIG. 8 is a block diagram illustrating the digital compensation unit 200 according to exemplary embodiments, and FIG. 9 is a schematic diagram illustrating a digital compensation process according to exemplary embodiments.

The digital compensation unit 200 may perform digital compensation to lower the digital gradation of each pixel based on a luminance of a pixel in which a maximum degradation rate has been generated among estimated degradation rates. As illustrated in FIG. 8 the digital compensation unit 200 may, according to exemplary embodiments, include a digital adjustment luminance calculator 210, a digital adjustment voltage calculator 220, and a digital voltage adjuster 230. The digital compensation unit 200 may further include an adjustment gradation calculator 240.

Digital compensation may be performed to reduce a degradation in uniformity occurring due to a difference in a degradation rate between a pixel and a channel. However, if a decrease in luminance occurs, the luminance may not be increased without a rising digital gradation margin. Thus, a method of improving uniformity by lowering a digital gradation may be used, based on the luminance of the pixel in which a maximum degradation rate occurs among the pixels of all channels.

To this end, the digital adjustment luminance calculator 210 may multiply an adjustment ratio (i.e., the ratio between the degradation rate of the pixel having the highest degradation rate and the degradation rate of the pixel to be compensated) by the luminance of the pixel to be compensated to calculate a digital adjustment luminance value.

Referring to FIG. 9, in one example it may be assumed that a starting luminance and an input gradation, as illustrated in the upper left of FIG. 9, are progressively degraded, to provide a luminance as illustrated in the upper right of FIG. 9. A pixel having a luminance value of 350 after degradation, among pixels illustrated in the upper right of FIG. 9, is a pixel having the highest degradation rate of 0.7 (i.e., 350/500) among the pixels illustrated in the upper right of FIG. 9. For example, if the degradation rate of a pixel to be compensated is 0.9, the digital adjustment luminance value may be 350 (obtained by multiplying the luminance of the pixel, 450, by an adjustment ratio, 7/9). The adjustment ratio (e.g., 7/9) may be obtained by dividing the degradation rate of the pixel having the highest degradation rate by the degradation rate of the pixel to be compensated.

Next, the digital adjustment voltage calculator 220 may calculate a voltage value to be applied to the pixel to be compensated from the digital adjustment luminance value. The voltage value may be calculated using the relationship between the luminance and the voltage, which may depend on panel characteristics. For example, the digital adjustment voltage calculator 220 may calculate a voltage value to be applied to the pixel, such that the luminance of the pixel to be compensated may be reduced from 450 to 350. This value may be the a digital adjustment luminance value.

In this case, a predetermined voltage-luminance relationship (i.e., an I-V curve) may be used according to characteristics of a panel. For example, as illustrated in FIG. 9, the adjustment voltage to be applied to a pixel having a degradation rate of 1 may be calculated to be 3.7 V; the adjustment voltage to be applied to a pixel having a degradation ratio of 0.9 may be calculated to be 3.5 V; and the adjustment voltage to be applied to a pixel having a degradation rate of 0.8 may be calculated as 3.2 V. The voltage-luminance relationship (the I-V curve) may be determined by measuring the normalized luminance as a function on the input voltage.

The digital voltage adjuster 230 may apply an adjustment voltage value, (i.e., the value calculated by the digital adjustment voltage calculator 220) to the pixel to be compensated in order to lower the digital gradation.

According to exemplary embodiments, the adjustment gradation calculator 240 may calculate an adjustment gradation of the pixel to be compensated from the adjustment voltage value calculated by the digital adjustment voltage calculator 220. The adjustment gradation may be calculated using a degradation corresponding to a panel characteristic and a voltage. This adjustment gradation may be obtained from a gamma curve indicating the relationship (i.e., a P-V curve) between the gradation and the driving voltage. The lower left of FIG. 9 shows an adjustment gradation calculated by the adjustment gradation calculator 240. The gamma curve may be determined according to the panel characteristics, and may change as the display luminance is adjusted.

According to an exemplary embodiment, the adjustment gradation calculator 240 may also simplify a relationship (i.e., the I-V curve) between the voltage and the luminance and a relationship (i.e., the P-V curve) between the gradation and the voltage, to a relationship (i.e., an I-P curve) between the luminance and the gradation. Then, adjustment gradation calculator 240 may calculate the adjustment gradation of a pixel to be compensated from the digital adjustment luminance value. The hardware complexity of a device may be reduced by simplifying the relationship between the luminance and voltage and gradation to a direct relationship of the luminance and gradation.

Using the relationship between the luminance-voltage-gradation for the gradation for changing to a specific luminance ratio (which may be based on panel characteristics) may improve the accuracy of the gradation calculation. In addition, color distortion, regional afterimage and the like (e.g., due to a difference in a degradation speed between pixels or channels) may be reduced through the digital compensation. For example, an afterimage due to high luminance output may occur in a fingerprint sensing region of fingerprint-on-display (FoD), and such an afterimage may be prevented by digital compensation.

Figure 10:
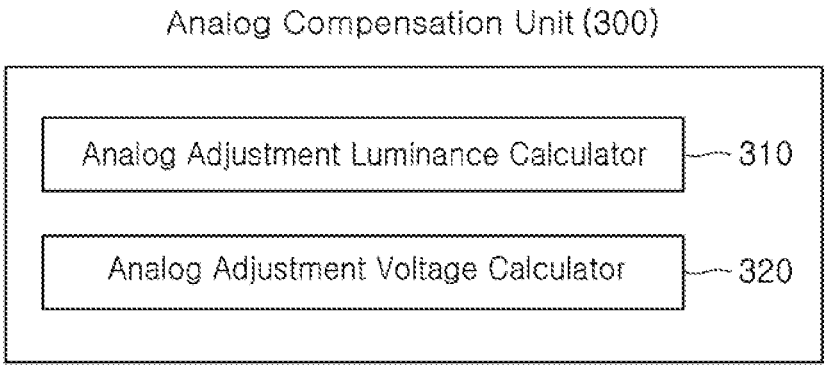
FIG. 10 is a block diagram of an analog compensation unit according to exemplary embodiments of the present inventive concept.
Figure 11:
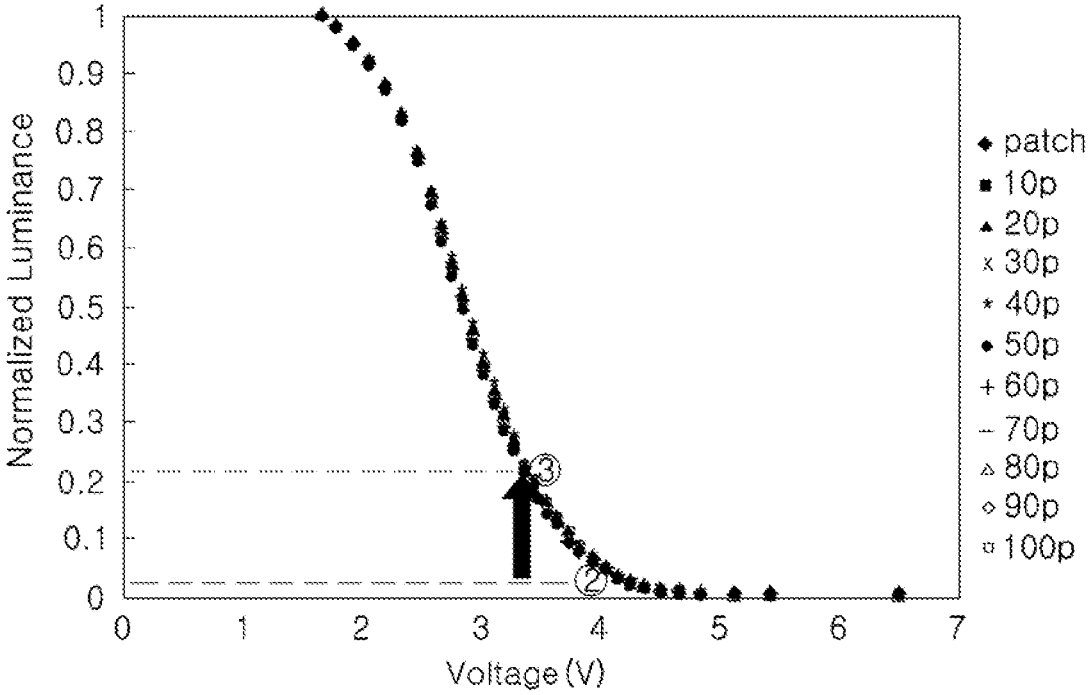
FIG. 11 illustrates an I-V curve applied to calculate an analog adjustment voltage in an analog adjustment voltage calculator according to exemplary embodiments of the present inventive concept.
Figure 12:
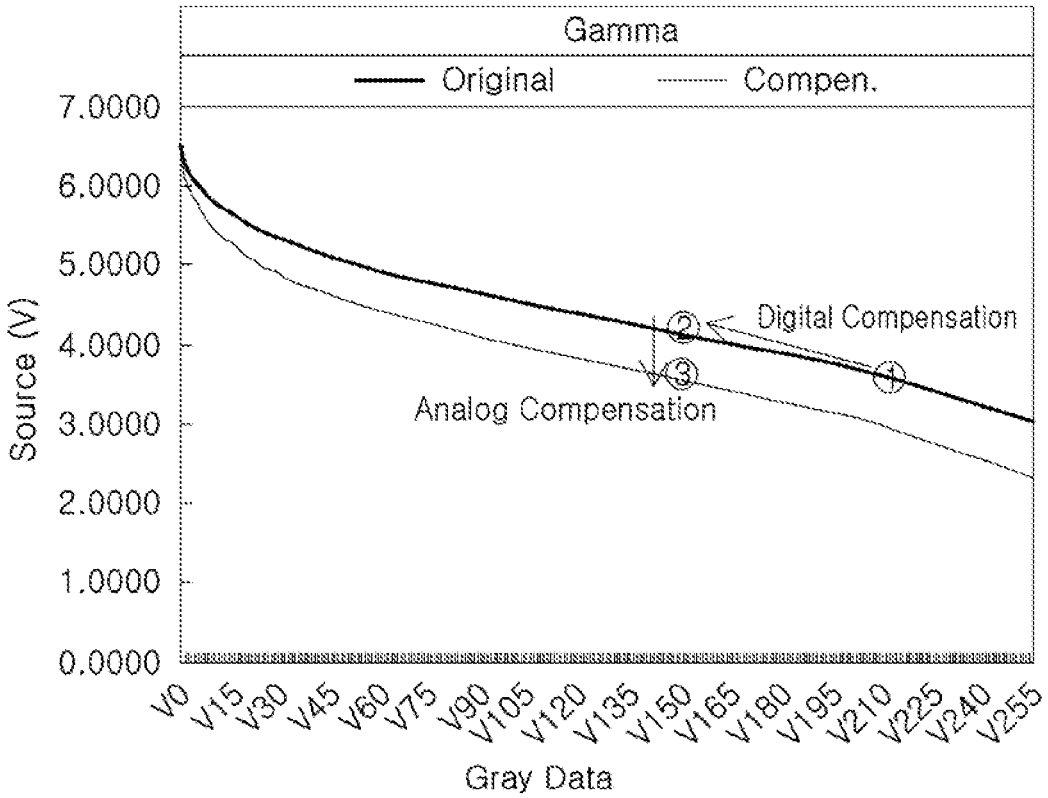
FIG. 12 is a graph illustrating a change in a gamma tap voltage value during digital compensation and analog compensation according to exemplary embodiments of the present inventive concept.

FIG. 10 is a block diagram of an analog compensation unit according to exemplary embodiments, FIG. 11 illustrates an I-V curve applied to calculate an analog adjustment voltage in an analog adjustment voltage calculator according to exemplary embodiments, and FIG. 12 is a graph illustrating a change in a gamma tap voltage value during digital compensation and analog compensation according to exemplary embodiments.

The analog compensation unit 300 may perform analog compensation to increase the luminance of a plurality of pixels by changing the analog voltage supplied to a panel after performing the digital compensation. The analog compensation unit 300, according to exemplary embodiments, may include an analog adjustment luminance calculator 310 and an analog adjustment voltage calculator 320.

The analog adjustment luminance calculator 310 may calculate an analog adjustment luminance value by multiplying the inverse of an adjustment ratio (specifically, the ratio between the degradation rate of a pixel having the highest degradation rate and the degradation rate of the pixel to be compensated) by the luminance of the pixel to be compensated. For example, the the adjustment ratio may be 7/9, and the inverse of the ratio, 9/7, may be multiplied by the luminance of the pixel to be compensated (which may have already been digitally compensated) to calculate the adjusted analog adjustment luminance value.

The analog adjustment voltage calculator 320 may calculate a gamma tap voltage value (to be applied to the pixel to be compensated) from the analog adjustment luminance value calculated by the analog adjustment luminance calculator 310. The gamma tap voltage value may be calculated using the relationship between the luminance and the voltage, which may depend on panel characteristics. The analog adjustment voltage calculator 320 may then add the gamma tap voltage value to the pixel to be compensated.

The gamma tap voltage value may be calculated using the voltage-luminance relationship (i.e., the I-V curve) as illustrated in FIG. 11. The value of the voltage to be adjusted may also be determined and used to increase the luminance to an analog adjustment luminance value calculated by the analog adjustment luminance calculator 310. The value of the voltage to be adjusted may depend on a difference in the luminance values to be changed. For example, to increase the luminance by a magnitude corresponding to the size of the arrow in the graph of FIG. 11 illustrating the voltage-luminance relationship, the voltage may be changed from point 2 (about 4 volts) to a value corresponding to an x coordinate value of point 3 on the I-V curve (i.e., about 3.4 volts). The x coordinate value at point 3 may correspond to a gamma tap voltage value calculated by the analog adjustment voltage calculator 320. The analog adjustment voltage calculator 320 may add the calculated gamma tap voltage value to the pixel to be compensated to adjust the luminance of the pixel.

As illustrated in FIG. 12, according to exemplary embodiments, the change in the gamma tap voltage during the process of digital compensation may correspond to moving from point 1 to point 2 on the upper curve. Then, the change in voltage during the process of performing analog compensation may correspond to moving from point 2 on the upper curve to point 3 on the lower curve.

In an exemplary embodiment of the present inventive concept, if the compensation is performed for each gamma tap based on a preset gamma curve, it may be performed without gamma distortion. For example, a high luminance output may be required in a fingerprint region to perform fingerprint sensing in an FoD, and a decrease in luminance due to degradation may cause degradation in fingerprint recognition performance. However, the decrease in recognition performance may be prevented by luminance compensation by compensating for degradation according to exemplary embodiments of the present inventive concept.

Figure 13:
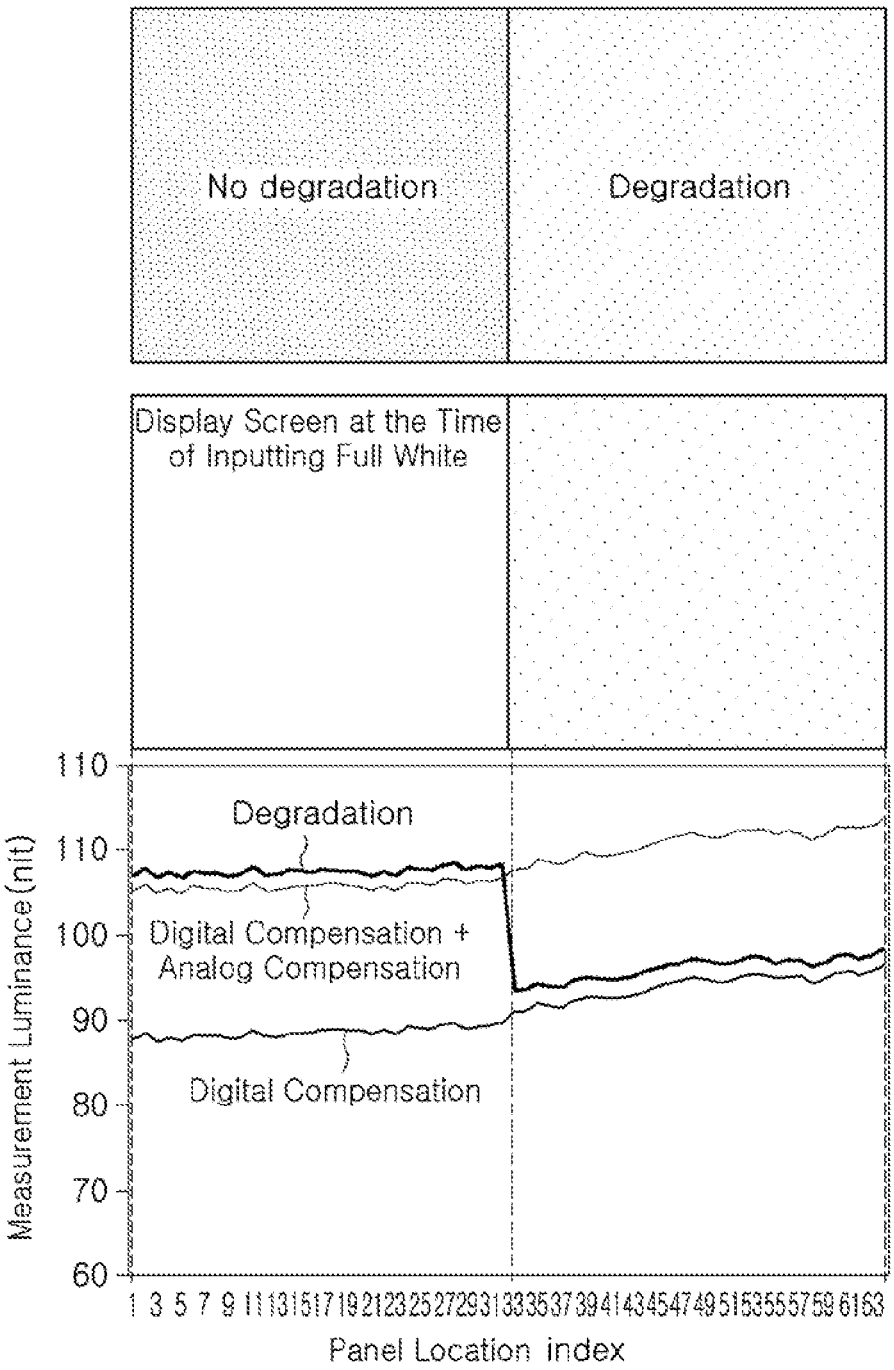
FIG. 13 is a diagram illustrating the effect of use of a degradation compensation device according to exemplary embodiments of the present inventive concept.

FIG. 13 is a diagram illustrating the effect of using a degradation compensation device according to exemplary embodiments. Specifically, FIG. 13 illustrates an example in which only the right panel of a device with multipole panels has been degraded. In the lower graph of FIG. 13, a rapid decreases in a boundary portion of degradation curve may be caused by a decrease in the luminance of the right panel due to degradation (and minimal or no degradation in the left panel).

When a uniform (full white) image is input, color distortion may also occur due to a decrease in the luminance of a specific channel (i.e., a blue channel), and a boundary may appear in the form of an afterimage.

According to exemplary embodiments, if modulation is performed then, after digital compensation, the luminance can be made more smooth as indicated by the lowermost curve in the lower graph of FIG. 13. That is, using the method of lowering a digital gradation, uniformity may be improved to the level equivalent to that of the luminance of the region that has not been degraded. In addition, color distortion may be reduced by applying the same degradation rate between channels.

After the digital compensation, the luminance may be restored to the starting luminance (i.e., the luminance before degradation) through analog compensation. In the lower graph of FIG. 13, there is an upper curve having a shape similar to the lowermost curve over a measured luminance of about 110, which represents the luminance value after being restored by analog compensation.

Figure 14:
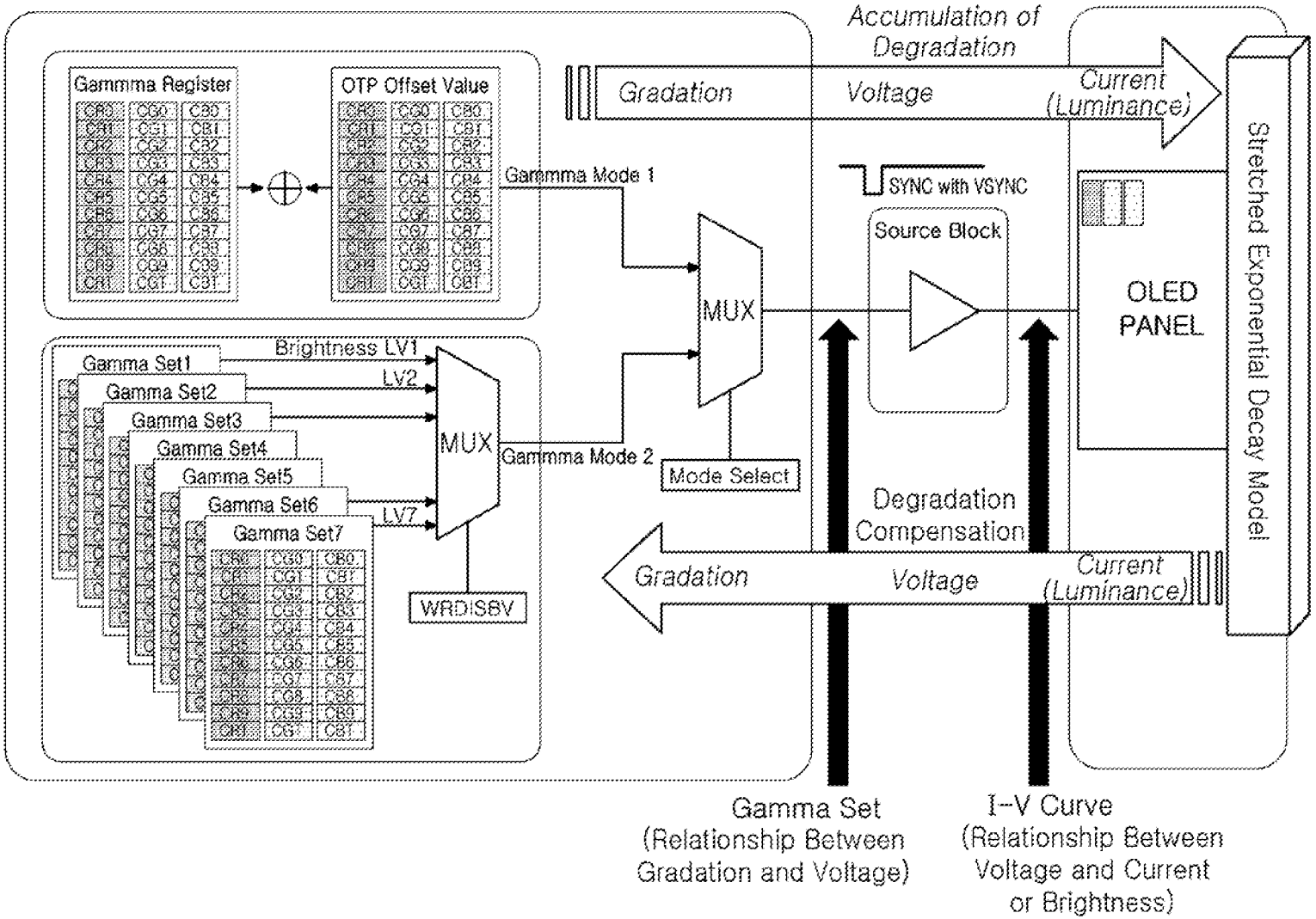
FIG. 14 is a diagram illustrating an overall operation of a degradation compensation device according to exemplary embodiments of the present inventive concept.

FIG. 14 is a diagram illustrating the overall operation of a degradation compensation device according to exemplary embodiments. When non-uniform degradation occurs during the use of an OLED display device, the degradation compensation device may accurately calculate and predict the amount of degradation based on the driving voltage information available from a panel. For example, degradation compensation device generate a stretched exponential decay model based on the voltage information supplied from the source block stage to the OLED panel. The cumulative degradation amount may be predicted through the stretched exponential decay model, and the degradation may be mitigated using digital and analog compensation processes.

As illustrated in FIG. 14, the digital compensation may improve the image quality uniformity through the relationship (i.e., an I-V curve) between voltage and current (or luminance) and the relationship (i.e., a gamma curve) between gradation and voltage. In the analog compensation process, a gamma tap voltage for compensation may be calculated by referring to the relationship between the voltage and the luminance. The gamma tap voltage for degradation compensation may be reflected in a source block supplying a voltage to the panel as indicated by arrows at the bottom of FIG. 14, so that the gamma tap voltage may be applied to the OLED panel and analog compensation may be performed.

A gamma register set to correspond to the gamma tap voltage may be calculated to update the previous gamma register set. Thus, analog compensation may be performed for each gamma tap, based on a gamma curve.

As set forth above, according to exemplary embodiments, digital compensation and analog compensation may be performed using a degradation rate predicted based on a voltage for actual pixel output, depending on panel characteristics. The digital compensation and analog compensation may generate accurate compensation data corresponding to the physical characteristics of a panel in order to maintain a starting luminance.

While exemplary embodiments have been shown and described above, it will be apparent to those skilled in the art that modifications and variations could be made without departing from the scope of the present inventive concept as defined by the appended claims.

What is claimed is:

1. A degradation compensation device, comprising:

a degradation rate acquisition unit configured to acquire estimated degradation rates for a plurality of pixels using a stretched exponential decay model generated using cumulative degradation amount information obtained by accumulating a degradation amount based on panel usage information;

a digital compensation unit configured to perform digital compensation to lower a digital gradation of each of the plurality of pixels based on a luminance of a same pixel having a maximum degradation rate among the estimated degradation rates; and an analog compensation unit configured to perform analog compensation to increase luminance of the plurality of pixels by changing an analog voltage supplied to a panel after performing the digital compensation.

2. The degradation compensation device of claim 1, wherein the degradation rate acquisition unit comprises a degradation amount acquisition configured to obtain the cumulative degradation amount information by accumulating the degradation amount based on a voltage for actual pixel output for a panel on a display driver stage.

3. The degradation compensation device of claim 2, wherein the degradation rate acquisition unit further comprises a degradation rate estimator configured to estimate a degradation rate for each of the plurality of pixels by passing the cumulative degradation amount information through the stretched exponential decay model defined by a degradation rate function over time, wherein the stretched exponential decay model is represented by $$\frac{L}{L_0} = \exp\left[-\left(\frac{t}{\tau}\right)^{\beta}\right]$$

where L is a luminance, t is a time variable, $\tau$ is a time taken for degradation to reach a predetermined reference level with respect to a starting luminance, $\beta$ denotes a parameter related to a degradation type determined for each channel irrespective of a gradation, and $L_0$ is the starting luminance.

4. The degradation compensation device of claim 1, wherein the digital compensation unit comprises a digital adjustment luminance calculator configured to calculate a digital adjustment luminance value by multiplying a luminance of a pixel to be compensated by a ratio between the maximum degradation rate and a degradation rate of the pixel to be compensated.

5. The degradation compensation device of claim 4, wherein the digital compensation unit further comprises:

a digital adjustment voltage calculator configured to calculate a voltage value to be applied to the pixel to be compensated based on the digital adjustment luminance value, using a relationship between luminance and voltage corresponding to panel characteristics; and a digital voltage adjuster configured to apply the voltage value calculated by the digital adjustment voltage calculator to the pixel to be compensated.

6. The degradation compensation device of claim 5, wherein the digital compensation unit further comprises an adjustment gradation calculator configured to calculate an adjustment gradation of the pixel to be compensated based on the voltage value using a relationship between gradation and voltage corresponding to panel characteristics.

7. The degradation compensation device of claim 5, wherein the digital compensation unit further comprises an adjustment gradation calculator configured to calculate an adjustment gradation of the pixel to be compensated based on the digital adjustment luminance value using a simplified relationship between luminance and gradation, wherein the simplified relationship is based on the relationship between luminance and voltage and a relationship between gradation and voltage corresponding to the panel characteristics.

8. The degradation compensation device of claim 1, wherein the analog compensation unit comprises an analog adjustment luminance calculator configured to calculate an analog adjustment luminance value by multiplying a luminance of a pixel to be compensated by an inverse of a ratio between the maximum degradation rate and a degradation rate of the pixel to be compensated.

9. The degradation compensation device of claim 8, wherein the analog compensation unit further comprises an analog adjustment voltage calculator configured to calculate a gamma tap voltage value to be applied to the pixel to be compensated based on the analog adjustment luminance value using a relationship between luminance and voltage corresponding to panel characteristics, and to apply the gamma tap voltage value to the pixel to be compensated.

10. The degradation compensation device of claim 2, wherein the degradation amount is a based on a time taken for luminance to decrease from a starting luminance to a predetermined ratio of the starting luminance by continuously applying a constant voltage.

11. An organic light emitting display device comprising:

a panel; and a degradation compensation device, wherein the degradation compensation device includes:

a degradation rate acquisition unit configured to acquire estimated degradation rates for a plurality of pixels using a stretched exponential decay model generated using cumulative degradation amount information obtained by accumulating a degradation amount based on usage information of the panel;

a digital compensation unit configured to perform digital compensation on the plurality of pixels using the estimated degradation rates; and an analog compensation unit configured to perform analog compensation after the digital compensation by changing an analog voltage supplied to the panel.

12. The organic light emitting display device of claim 11, wherein the usage information with respect to the panel is voltage information for actual pixel output based on a display driver stage of the panel.

13. The organic light emitting display device of claim 11, wherein the stretched exponential decay model is represented by $$\frac{L}{L_0} = \exp\left[-\left(\frac{t}{\tau}\right)^{\beta}\right]$$

where L is a luminance, t is a time variable, τ is a time taken for degradation to reach a predetermined reference level with respect to a starting luminance, β denotes a parameter related to a degradation type and a value determined for each channel irrespective of a gradation, and $L_0$ is the starting luminance.

14. The organic light emitting display device of claim 11, wherein the digital compensation unit comprises a digital adjustment luminance calculator configured to calculate a digital adjustment luminance value by multiplying a luminance of a pixel to be compensated by a ratio between a degradation rate of a pixel having a highest degradation rate and a degradation rate of the pixel to be compensated.

15. The organic light emitting display device of claim 14, wherein the digital compensation unit further comprises:

a digital adjustment voltage calculator configured to calculate a voltage value to be applied to the pixel to be compensated based on the digital adjustment luminance value using a relationship between luminance and voltage corresponding to characteristics of the panel, and to apply the voltage value calculated by the digital adjustment voltage calculator to the pixel to be compensated; and an adjustment gradation calculator configured to calculate an adjustment gradation of the pixel to be compensated from the voltage value using a relationship between voltage and 20 gradation corresponding to the characteristics of the panel.

16. The organic light emitting display device of claim 15, wherein the adjustment gradation calculator is configured to calculate an adjustment gradation of the pixel to be compensated based on the digital adjustment luminance value using a simplified relationship between luminance and gradation, wherein the simplified relationship is based on the relationship between voltage and luminance and the relationship between gradation and voltage.

17. The organic light emitting display device of claim 11, wherein the analog compensation unit comprises an analog adjustment luminance calculator configured to calculate an analog adjustment luminance value by multiplying a luminance of the pixel to be compensated by an inverse of a ratio between a degradation rate of a pixel having a highest degradation rate and a degradation rate of the pixel to be compensated.

18. The organic light emitting display device of claim 17, wherein the analog compensation unit comprises an analog adjustment voltage calculator configured to calculate a gamma tap voltage value to be applied to the pixel to be compensated based on the analog adjustment luminance value using a relationship between luminance and voltage corresponding to characteristics of the panel, and to apply the gamma tap voltage value to the pixel to be compensated.

19. The organic light emitting display device of claim 11, wherein the degradation amount is based on a time taken for luminance to decrease from a starting luminance to a predetermined ratio of the starting luminance by continuously applying a constant voltage.

20. An organic light emitting display (OLED) device comprising:

a panel; and a degradation compensation device configured to:

estimate degradation rates with respect to a plurality of pixels by passing cumulative degradation amount information through a stretched exponential decay model defined by a degradation rate function over time, using voltage information for actual pixel output based on the panel, calculate a compensation voltage for each of the plurality of pixels based on a luminance of a pixel having a maximum degradation rate among the estimated degradation rates, supply the compensation voltage to the plurality of pixels, and calculate a gamma tap voltage supplied to the panel to change an analog voltage of a source driver.

* * * * *